US011655076B2

(12) United States Patent
Fang

(10) Patent No.: US 11,655,076 B2
(45) Date of Patent: May 23, 2023

(54) LIQUID TRANSPORT SYSTEM AND A LINER BAG AND A METHOD OF USING THE SAME

(71) Applicant: SHANGHAI HONGYAN RETURNABLE TRANSIT PACKAGINGS CO., LTD, Shanghai (CN)

(72) Inventor: Zhengwei Fang, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 0 days.

(21) Appl. No.: 16/324,398

(22) PCT Filed: Jul. 31, 2017

(86) PCT No.: PCT/CN2017/095156
§ 371 (c)(1),
(2) Date: Feb. 8, 2019

(87) PCT Pub. No.: WO2018/028450
PCT Pub. Date: Feb. 15, 2018

(65) Prior Publication Data

US 2019/0168942 A1 Jun. 6, 2019

(30) Foreign Application Priority Data

Aug. 8, 2016 (CN) ..... 201610642487.2
Aug. 8, 2016 (CN) ..... 201610642731.5
Nov. 14, 2016 (CN) ..... 201611024953.7

(51) Int. Cl.
*B65D 90/04* (2006.01)
*B65D 33/01* (2006.01)
(Continued)

(52) U.S. Cl.
CPC ..... *B65D 33/01* (2013.01); *B65D 35/285* (2013.01); *B65D 77/065* (2013.01); *B65D 85/72* (2013.01);
(Continued)

(58) Field of Classification Search
CPC ..... B65D 77/065; B65D 90/046; B65D 85/72
(Continued)

(56) References Cited

U.S. PATENT DOCUMENTS

RE29,721 E * 8/1978 Ukmar ..... B65D 90/008 222/530
4,946,040 A * 8/1990 Ipenburg ..... B65D 75/5872 215/11.3
(Continued)

FOREIGN PATENT DOCUMENTS

CA 2766948 A * 1/2011
CN 1130144 A 9/1996
(Continued)

OTHER PUBLICATIONS

International Search Report (English and Chinese) and Written Opinion issued in PCT/CN2017/095156, dated Oct. 12, 2017, 10 pages provided.
(Continued)

*Primary Examiner* — Stephen J Castellano
(74) *Attorney, Agent, or Firm* — Hamre, Schumann, Mueller & Larson, P.C.

(57) ABSTRACT

The invention discloses a liquid transport system and a liner bag and a method of using the same. The liquid transport system includes a intermediate bulk container and a liner bag, wherein the intermediate bulk container includes a base and a side wall mounted to the base, the base is provided with a valve port, and the liner bag includes a liner bag body and a discharge port. The liner bag body is formed by
(Continued)

hermetically welding a front panel and a rear panel along the periphery thereof, and the discharge port is hermetically connected to the liner bag body, and the distance between an edge of the discharge port and a weld line of the liner bag body is set to a minimum. The liner bag is placed in the intermediate bulk container and the discharge port of the liner bag is installed in the valve port. The liner bag is arranged in such a manner that after the liner bag is filled, a plane where the weld lines are located is perpendicular to the base. The liquid transport system and liner bag of the present invention are simple to manufacture and facilitate the discharge of liquids, particularly viscous liquids, contained therein.

14 Claims, 8 Drawing Sheets

(51) Int. Cl.

| | |
|---|---|
| ***B65D 35/28*** | (2006.01) |
| ***B65D 77/06*** | (2006.01) |
| ***B65D 85/72*** | (2006.01) |
| ***B67D 7/00*** | (2010.01) |
| *B65D 5/56* | (2006.01) |
| *B67D 7/02* | (2010.01) |

(52) U.S. Cl.
CPC ..... *B67D 7/00* (2013.01); *B65D 5/56* (2013.01); *B65D 90/046* (2013.01); *B65D 2590/046* (2013.01); *B67D 7/0216* (2013.01)

(58) Field of Classification Search
USPC ..... 383/66
See application file for complete search history.

(56) References Cited

U.S. PATENT DOCUMENTS

| | | | | |
|---|---|---|---|---|
| 5,788,121 | A * | 8/1998 | Sasaki | B65D 77/065 222/105 |
| 6,032,818 | A * | 3/2000 | Olson | B65D 77/06 220/495.01 |
| 2006/0278656 | A1 | 12/2006 | Ross | |
| 2014/0069941 | A1* | 3/2014 | Guerrero, Jr. | B65D 77/065 220/661 |
| 2015/0014356 | A1* | 1/2015 | Thomas | B65D 75/5883 222/107 |

FOREIGN PATENT DOCUMENTS

| | | | |
|---|---|---|---|
| CN | 102666305 | A | 9/2012 |
| CN | 103075564 | A | 5/2013 |
| CN | 104097853 | A | 10/2014 |
| GB | 2354754 | A | 4/2001 |
| GB | 2356854 | A | 6/2001 |
| JP | H0796946 | A | 4/1995 |
| JP | H07232792 | A | 9/1995 |
| JP | H11152184 | A | 6/1999 |
| JP | 2004074541 | A | 3/2004 |
| JP | 2005512905 | A | 5/2005 |
| JP | 2007106478 | A | 4/2007 |
| JP | 2011131908 | A | 7/2011 |
| JP | 3202619 | U | 2/2016 |
| WO | 9902424 | A1 | 1/1999 |
| WO | 2014203135 | A1 | 12/2014 |
| WO | 2015192789 | A1 | 12/2015 |

OTHER PUBLICATIONS

Supplementary European Search Report issued in European U.S. Appl. No. 17/838,580, dated Feb. 17, 2020.

* cited by examiner

LIQUID TRANSPORT SYSTEM AND A LINER BAG AND A METHOD OF USING THE SAME

This application is the national stage (Rule 371) of international application No. PCT/CN2017/095156 filed on 31 Jul. 2017.

CROSS-REFERENCE OF RELATED APPLICATIONS

This application claims the priorities of Chinese patent application CN2016106424872, entitled "Fluid discharge system and method", filed on Aug. 8, 2016; Chinese patent application CN2016106427315, entitled "Fluid discharge system and method", filed on Aug. 8, 2016; and Chinese patent application CN201611024953.7, entitled "Liquid transport system and liner bag and a method of using the same", filed on Nov. 14, 2016, the entire disclosures thereof are incorporated herein by reference.

TECHNICAL FIELD

The present invention relates to a container, and in particular to a liner bag for containing liquid.

BACKGROUND OF THE INVENTION

For liquid storage, transportation, filling and discharging etc., there are many liquid storage and transportation devices in the market, including intermediate bulk container with a liner bag for storage and transportation solution. The liner bag of intermediate bulk container in the market typically has two types: a six-faced stereoscopic liner bag and two-faced pillow-type liner bag. The stereoscopic liner bag has great difficulty in production, because each face of the stereoscopic liner bag has to be welded, thus the production efficiency is very low and the cost is relatively high. Pillow-type liner bag is increasingly used due to its convenience in use and low processing cost.

The conventional liner bag is a liner bag which is formed by sealing a front panel and a rear panel, and commonly called a "pillow bag". The pillow bag is generally hermetically connected to a discharge port for discharging the liquid in the liner bag. The discharge port is generally positioned on the front or rear panel of the liner bag and is hermetically connected to one of the panels at the center position or away from the edge of one of the panels.

FIGS. 1 and 3 show schematic views of the structures of two conventional prior liner bags 1, respectively. The solid and dashed lines in the middle of FIG. 1 represent the top and bottom surfaces after filling, respectively. The liner bag 1 of FIG. 1 is formed by hermetically welding of the front panel 2 and the rear panel 3. The edges of the front panel 2 and the rear panel 3 are formed with weld lines 4. A filling port 5 is provided on the front panel 2. A discharge port 6 is provided on the rear panel 3. The discharge port shown in FIG. 1 is distant from the weld line 4 by about ¼ of the length of the rear panel, such that when the liner bag is placed in an intermediate bulk container and filled with liquids, the discharge port can be located at the bottom of the intermediate bulk container. The main differences between the liner bag of FIG. 3 and the liner bag of FIG. 1 lie in the positions of the discharge port and the filling port. In the liner bag shown in FIG. 3, the discharge port and the filling port are the same port 7, which is located in the center of the front panel.

As shown in FIG. 2, the prior liner bags are typically placed in an intermediate bulk container when filling with the liquid. The conventional arrangement of the liner bag in the intermediate bulk container is as follows: 1. The discharge port is assembled to the position of a valve port of the intermediate bulk container, and the four corners of the liner bag are tiled in the middle or bottom of the intermediate bulk container; 2. The discharge port is assembled into the valve port of the intermediate bulk container, with two corners standing up on the top. After the liner bags are filled with liquids, the discharge ports are away from the position of the weld line of the liner bag, for example, by at least ¼ of length of the front or rear panel. The weld line of the liner bag is usually located in the middle of the intermediate bulk container and is parallel to the base of the intermediate bulk container. In this way, during the liquid discharging or after the discharge is completed, the liquid remains in the four corners of the liner bag, and the residue amount is large, and the removal of the residue is complicated.

SUMMARY OF THE INVENTION

It is an object of the present invention to provide a liner bag and liquid transport system that facilitates welding and facilitates the discharge of liquids, particularly viscous liquids, contained therein.

In order to achieve the above object, according to an aspect of the present invention, there provides a liner bag including a liner bag body, which is formed by hermetically welding a front panel and a rear panel along the periphery thereof, and a discharge port, which is hermetically connected to the liner bag body, and a minimum distance between an edge of the discharge port and a weld line of the liner bag body is L, wherein $0 \le L \le 20$ cm.

Preferably, $0 \le L \le 10$ cm. More preferably, $0 \le L \le 5$ cm.

Preferably, the front panel and the rear panel are rectangular flexible sheets.

Preferably, a portion of the bag body extends beyond the weld line of the side of the liner bag body farthest from the discharge port.

Preferably, a minimum distance S between the discharge port and the corner of the liner bag body is greater than 20 cm. More preferably, the minimum distance S is greater than 40 cm.

Preferably, the liner bag has a volume of 250 liters, 1000 liters or 1200 liters.

Preferably, the liner bag is used with an intermediate bulk container, the intermediate bulk container is provided with a valve port where the discharge port is installed.

According to another aspect of the present invention, there provides a liner bag including a liner bag body, which is formed by hermetically welding a front panel and a rear panel along the periphery thereof, and a discharge port, which is hermetically connected to the liner bag body, and a minimum distance between an edge of the discharge port and a weld line of the liner bag body is L, wherein $0 \le L \le 0.1*D$, where D is the minimum of lengths and widths of the front and rear panels.

Preferably, $0 \le L \le 0.05*D$. More preferably, $0 \le L \le 0.025*D$.

Preferably, the front panel and the rear panel are rectangular flexible sheets.

Preferably, the liner bag has a volume of 250 liters, 1000 liters or 1200 liters.

Preferably, the liner bag is used with an intermediate bulk container, the intermediate bulk container is provided with a valve port where the discharge port is installed.

According to another aspect of the present invention, there provides a liner bag including a liner bag body, which is formed by hermetically welding a front panel and a rear panel along the periphery thereof, thereby forming primary weld lines along the entire periphery of the liner bag body, and an secondary weld line is also formed between the at least two primary weld lines, with the two primary weld lines connecting with the secondary line; and a discharge port, which is hermetically connected to the liner bag body, and a minimum distance between an edge of the discharge port and the primary or secondary weld line is L, wherein $0 \leq L \leq 0.1*D$, D is the minimum of lengths and widths of the front and rear panels.

Preferably, the front panel and the rear panel are rectangular flexible sheets.

According to another aspect of the present invention, there provides a liner bag including a liner bag body, which is formed by hermetically welding a front panel and a rear panel along the periphery thereof, at least one side of the liner bag body includes at least two sections of weld lines which are angled relative to each other; and a discharge port, which is hermetically connected to the liner bag body, and a minimum distance between an edge of the discharge port and a weld line of the liner bag body is L, wherein $0 \leq L \leq 20$ cm, or $0 \leq L \leq 0.1*D$, where D is the minimum of lengths and widths of the front and rear panels.

Preferably, $0 \leq L \leq 10$ cm. More preferably, $0 \leq L \leq 5$ cm.

Preferably, the discharge port is located at a bottom of a corner formed by the intersection of the two sections of weld lines which are connected to each other at an angle.

Preferably, the front panel and the rear panel are both formed by cutting off at least one corner of the rectangular sheet.

Preferably, the front panel and the rear panel are both formed by cutting off two adjacent corners of the rectangular sheet, and the two cut edges formed by cutting off the two corners intersect with each other.

According to another aspect of the present invention, there provides a liquid transport system comprising an intermediate bulk container and a liner bag, wherein the intermediate bulk container comprises a base and side walls mounted to the base, the base is provided with a valve port, and the liner bag comprises a liner bag body and a discharge port, wherein:

the liner bag body is formed by hermetically welding a front panel and a rear panel along the periphery thereof, the discharge port is hermetically connected to the liner bag body, and a minimum distance between an edge of the discharge port and an weld line of the liner bag body is L, wherein $0 \leq L \leq 20$ cm, or $0 \leq L \leq 0.1*D$, where D is the minimum of lengths and widths of the front and rear panels;

the liner bag is disposed in the intermediate bulk container and the discharge port of the liner bag is installed in the valve port; and the liner bag is arranged in such a manner that after the liner bag is filled, a plane where the weld line is located is perpendicular to the base.

Preferably, the liner bag is arranged in such a manner that after the liner bag is filled, the liner bag body is bilaterally symmetrical about the weld line.

Preferably, $0 \leq L \leq 10$ cm. More preferably, $0 \leq L \leq 5$ cm.

Preferably, $0 \leq L \leq 0.05*D$. More preferably, $0 \leq L \leq 0.025*D$.

Preferably, the front panel and the rear panel are both formed by cutting off at least one corner of the rectangular sheet.

Preferably, the front panel and the rear panel are both formed by cutting off two adjacent corners of the rectangular sheet, and the two cut lines formed by cutting off the two corners intersect with each other.

Preferably, the liner bag further includes a filling port arranged to lie on top of the liner bag after the liner bag is filled.

Preferably, the discharge port is arranged to be adjacent to the weld line on the base or the weld line perpendicular to the base after the liner bag is filled.

According to another aspect of the present invention, there provides a method for using a liner bag, wherein providing a liner bag comprising a liner bag body, which is formed by hermetically welding a front panel and a rear panel along the periphery thereof, and a discharge port, which is hermetically connected to the liner bag body, and the minimum distance between an edge of the discharge port and a weld line of the liner bag body is L, wherein $0 \leq L \leq 20$ cm, or $0 \leq L \leq 0.1*D$, where D is the minimum of lengths and widths of the front and rear panels;

placing the liner bag in an intermediate bulk container, wherein the intermediate bulk container comprises a base and side walls mounted to the base, the base is provided with a valve port where the discharge port of the liner bag is installed;

arranging the liner bag in such a manner that after the liner bag is filled, a plane where the weld line is located is perpendicular to the base.

Preferably, the liner bag is further arranged in such a manner that after the liner bag is filled, the liner bag body is bilaterally symmetrical about the weld line.

Preferably, $0 \leq L \leq 10$ cm. More preferably, $0 \leq L \leq 5$ cm.

Preferably, $0 \leq L \leq 0.05*D$. More preferably, $0 \leq L \leq 0.025*D$.

Preferably, the front panel and the rear panel are both formed by cutting off at least one corner of the rectangular sheet.

Preferably, the front panel and the rear panel are both formed by cutting off two adjacent corners of the rectangular sheet, and the two cut lines formed by cutting off the two corners intersect with each other.

The liner bag of the present invention is simple to manufacture and facilitates the discharge of liquids, particularly viscous liquids, contained therein.

THE DETAILED DESCRIPTIONS OF THE PREFERRED EMBODIMENTS

The preferred embodiments of the present invention will be described in detail below with reference to the accompanying drawings, so that the purposes, features and advantages of the present invention can be more clearly understood. It should be understood that the embodiments shown in the accompanying drawings are not intended to limit the scope of the present invention, and is only used for illustrating the essential spirit of the technical solution of the present invention.

Figure 1:
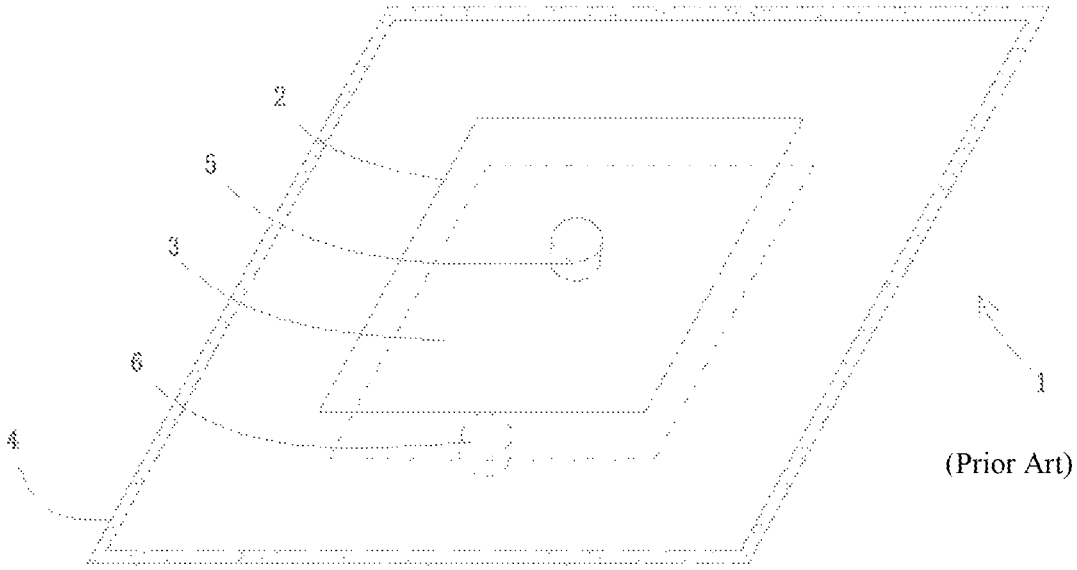
FIG. 1 is a schematic view showing the structure of a prior liner bag.
Figure 2:
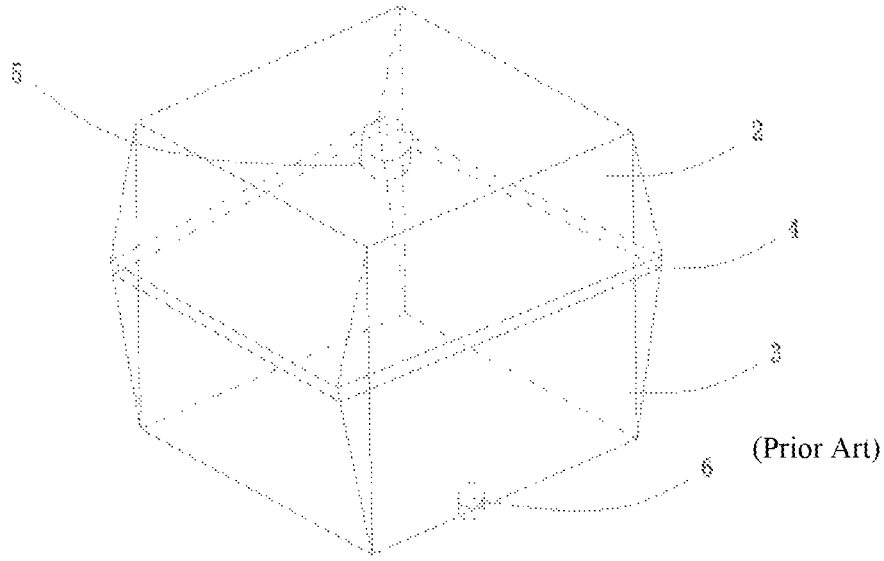
FIG. 2 is a view showing a state of the liner bag shown in FIG. 1 when it is filled with liquids.
Figure 3:
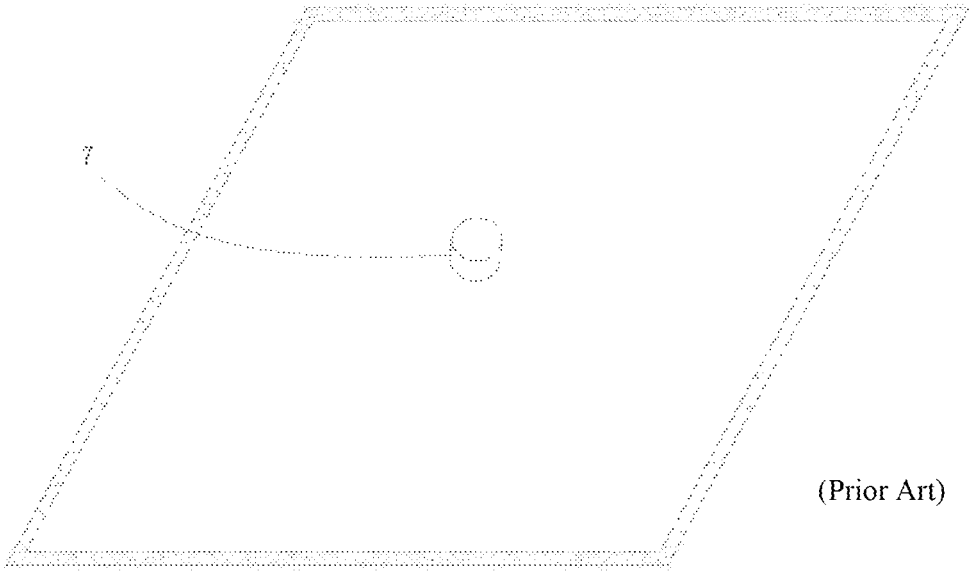
(Prior Art) Fig 3
FIG. 3 shows a schematic view of the structure of another prior liner bag.
Figure 4:
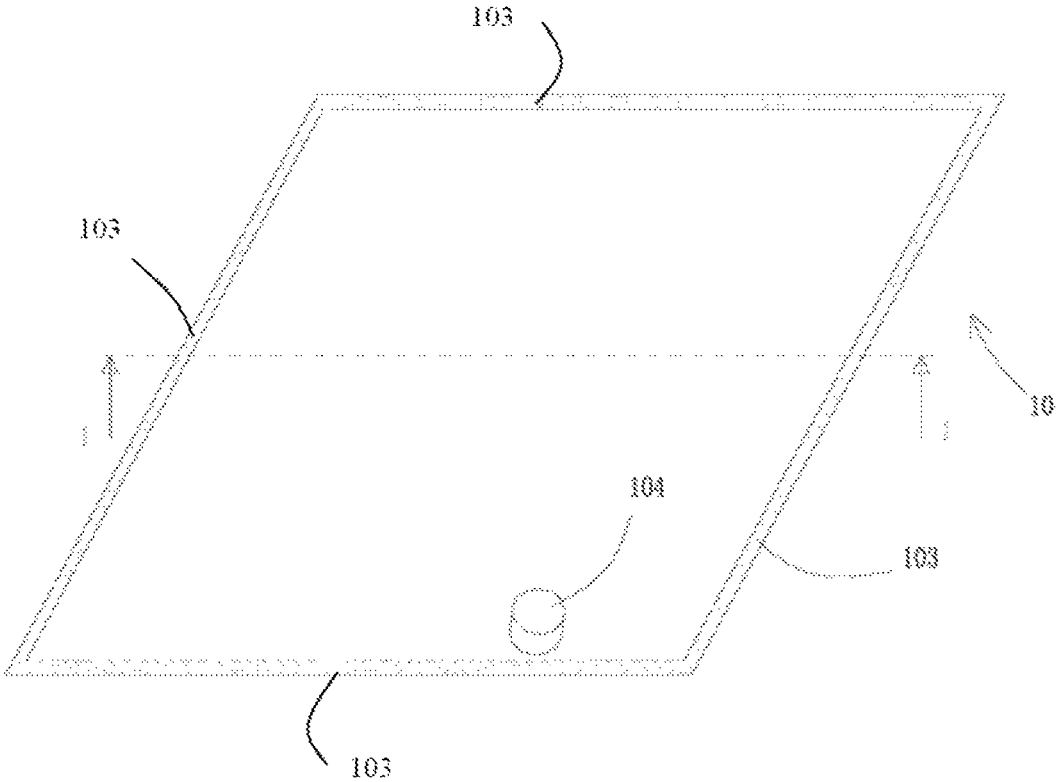
FIG. 4 shows a schematic view of the structure of a liner bag in accordance with an embodiment of the present invention.
Figure 5:
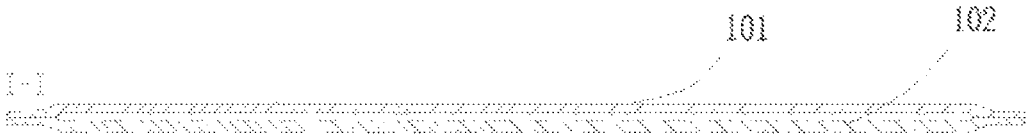
FIG. 5 shows a cross-sectional view of the liner bag of FIG. 4 taken along section line I-I.
Figure 6:
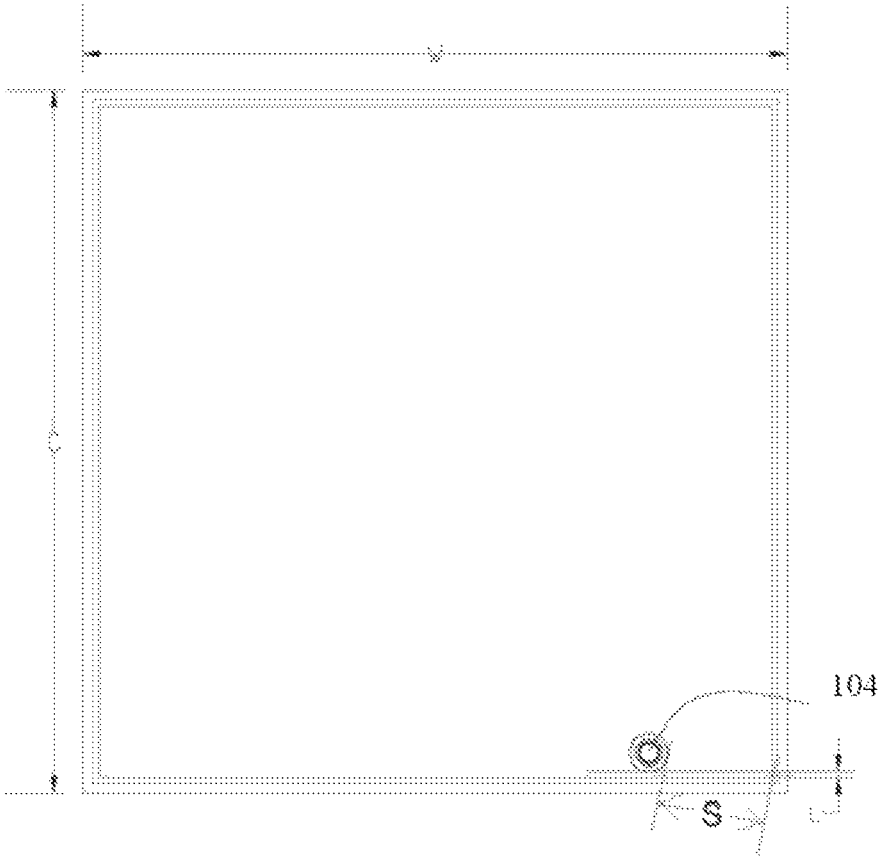
FIG. 6 shows a front view of the liner bag of FIG. 4.

As shown in FIGS. 4-6, the liner bag 10 includes a liner bag body and a discharge port 104. The liner bag body is formed by hermetically welding a front panel 101 and a rear panel 102 along the periphery thereof. Primary weld lines 103 are formed along the entire periphery of the liner bag body. Preferably, the front panel 101 and the rear panel 102 are rectangular flexible sheets. The discharge port 104 is hermetically connected to the liner bag body. Specifically, the discharge port 104 is welded to one of the front panel 101 and the rear panel 102. In the drawings, the discharge port 104 is welded to the front panel 101.

The discharge port 104 is arranged close to the weld line 103. In principle, the closer the edge of the discharge port 104 is to the weld line, the better the effect is. In an embodiment, it is assumed that the minimum distance between the edge of the discharge port 104 and the weld line 103 of the liner bag body is L, then $0 \leq L \leq 20$ cm. Preferably, $0 \leq L \leq 10$ cm. More preferably, $0 \leq L \leq 5$ cm. Alternatively, $0 \leq L \leq 0.1*D$, where D is the minimum length C or width W of the front or rear panel. Preferably, $0 \leq L \leq 0.05*D$. More preferably, $0 \leq L \leq 0.025*D$.

In order to prevent the four corners of the liner bag 10 from blocking the discharge ports during discharging, the discharge port 104 should have a distance from the corner of the liner bag body. Preferably, the minimum distance S between the discharge port 104 and the corner of the liner bag body should be greater than 20 cm. More preferably, S should be greater than 40 cm. It would be appreciated that the above minimum distance S is defined to be primarily applicable to the case where the liner bag is housed in a container having one base and four side walls mounted to the base. When the container is cylindrical or the container has more than four side walls, for example six side walls, the discharge port can also be located directly at the corner of the liner bag body, i.e., there is no limit for the minimum distance between the discharge port and the corner of the liner bag.

Herein, the sizes (i.e., volume) of the liner bag are typically 2501, 10001, and 12001. Correspondingly, the front panel and the rear panel are approximately 0.95 m*1.55 m, 2.1 m*2.25 m, and 2.1 m*2.45 m.

Figure 7:
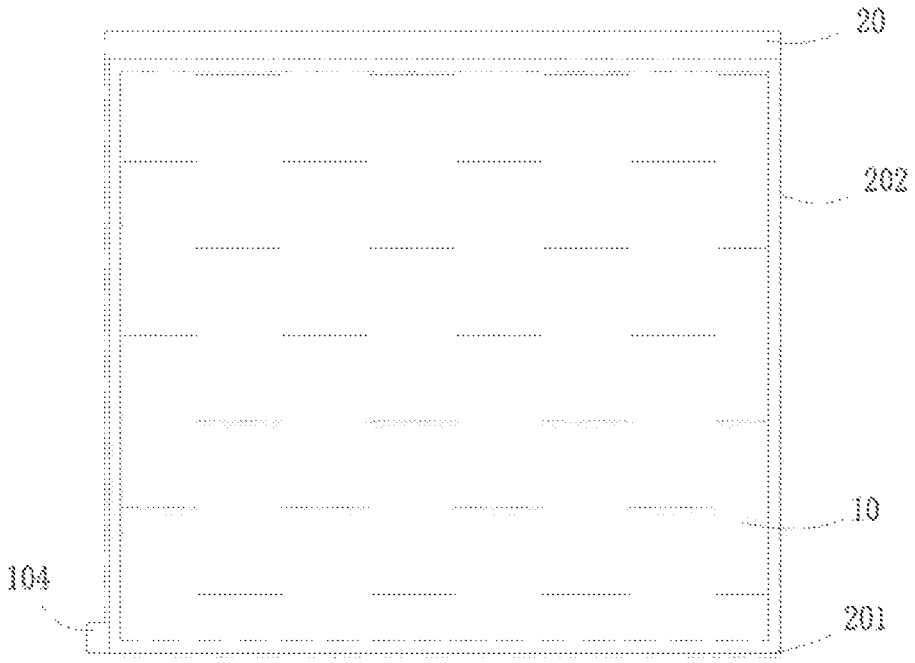
FIG. 7 is a schematic view showing the structure of the liner bag of FIG. 4 in an intermediate bulk container and filled with liquids.
Figure 8:
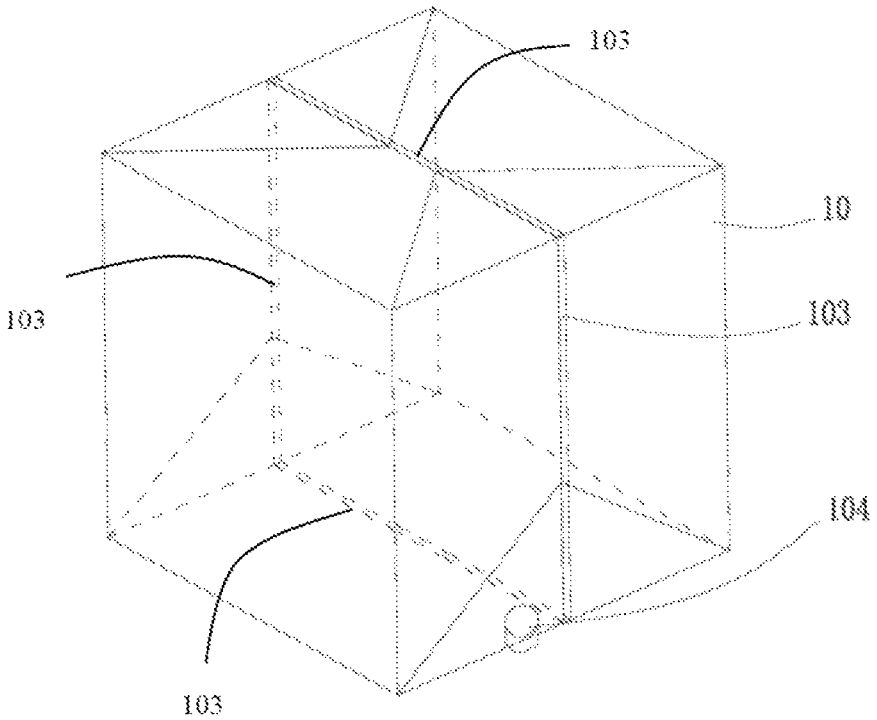
FIG. 8 is a perspective view showing the structure of the liner bag of FIG. 4 filled with liquids and deployed.

FIG. 7 illustrates the use of the above described liner bag 10 in an intermediate bulk container 20, which forms a liquid transport system with the intermediate bulk container. As shown in FIG. 7, the intermediate bulk container 20 includes a base 201 and a side wall 202 mounted to the base 201. The base 201 is provided with a valve port (not shown). The liner bag 10 is placed in the intermediate bulk container 20 and the discharge port 104 of the liner bag 10 is installed in the valve port. The liner bag 10 is arranged in such a manner that after the liner bag is filled, a plane where the weld lines 103 are located is perpendicular to the base 1, as shown in FIG. 8. Further, the liner bag is also arranged in such a manner that when the liner bag is filled, the liner bag body is bilaterally symmetrical about the weld lines 103. Thereby, when liquids, especially viscous liquids is being discharged, the liner bag can be clamped at the weld line by the extruding device, and the extruding force is applied to the liner bag while moving downward along the liner bag, thereby the liquid adhered to the inner surface of the liner bag is scraped off downward to reduce the residual liquid.

Specifically, by arranging the liner bag 10 in such a manner that after the liner bag is filled, a plane where the weld lines 103 are located is perpendicular to the base 1, it can facilitate extruding downward along the weld lines with the extruding device. In contrast, in the prior art, since the weld lines of the liner bag are substantially parallel to the base after the filling is completed, the extruding device is blocked by the weld lines and is difficult to complete the extruding when moving to the weld lines, thereby it is difficult to remove the adhered liquid on the inner surface of the liner bag. By disposing the discharge port near the weld line and arranging the liner bag in such a manner that after the liner bag is filled, the liner bag body is bilaterally symmetric about the weld lines, so that the liner bag is substantially axially symmetric about the discharge port, thus during the liquid discharging, the liquid can be relatively thoroughly discharged from the liner bag through the discharge port.

Figure 9:
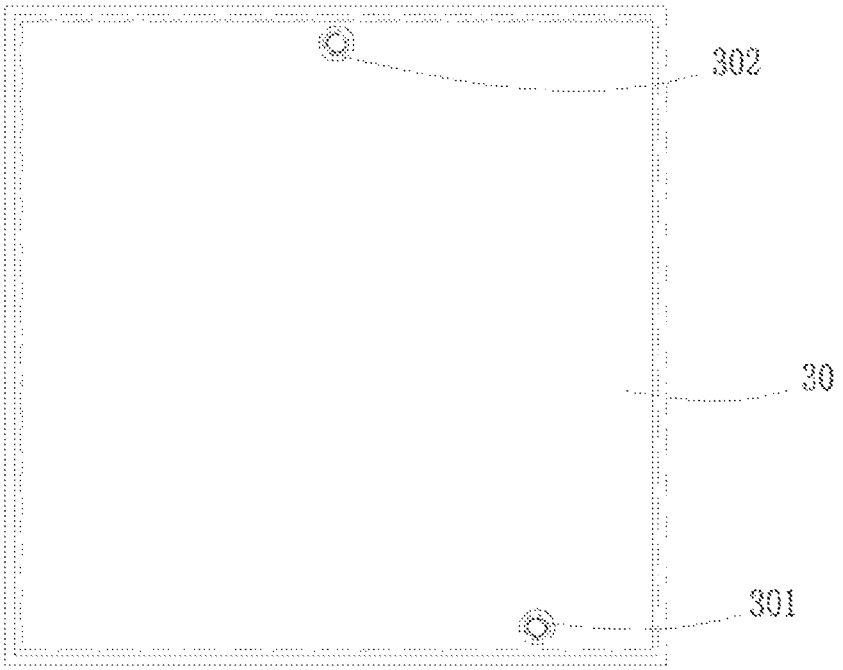
FIG. 9 is a view showing the structure of a first variant of the liner bag of FIG. 4.

FIG. 9 is a view showing the structure of a first variant of the liner bag of FIG. 4. The liner bag shown in FIG. 9 is mainly different from the liner bag shown in FIG. 4 in that, in the liner bag shown in FIG. 8, the discharge port is also used as a filling port, and in the liner bag 30 shown in FIG. 9, the discharge port 301 and the filling port 302 are provided separately, the discharge port 301 is close to the bottom edge of the liner bag, and the filling port 302 is close to the top edge of the liner bag. The rest are the same and will not be described in detail here.

Figure 10:
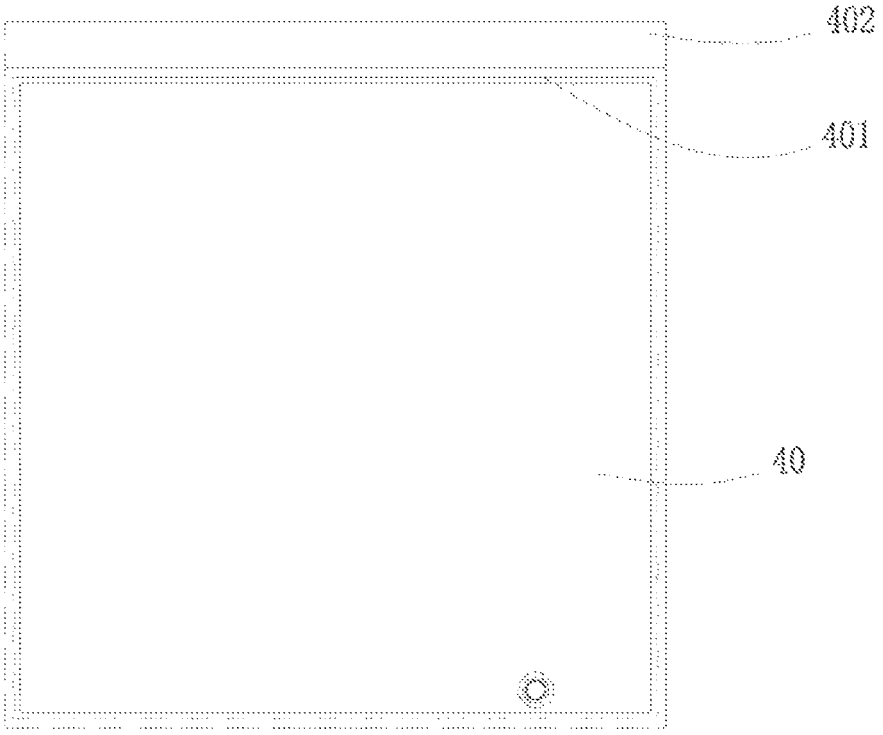
FIG. 10 is a view showing the structure of a second variant of the liner bag of FIG. 4.

FIG. 10 is a view showing the structure of a second variant of the liner bag of FIG. 4. The liner bag 40 shown in FIG. 10 is mainly different from the liner bag shown in FIG. 4 in that, in the liner bag 40 shown in FIG. 10, on the outer side of the weld line 401 on one side, that is, the weld line 401 farthest from the discharge port, a portion of the bag body 402 is also extended beyond there. The primary function of this portion of the bag body is to facilitate the gripping by the extruding device (which is used to extrude the liquid in the liner bag to reduce liquid residue). The rest are the same and will not be described in detail here.

Figure 11:
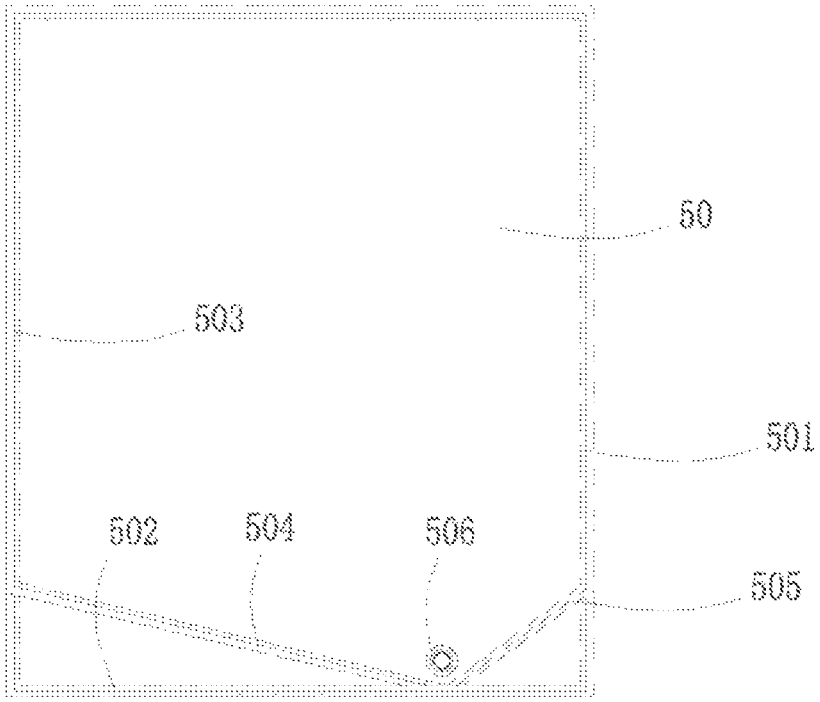
FIG. 11 is a view showing the structure of a third variant of the liner bag of FIG. 4.

FIG. 11 is a view showing the structure of a third variant of the liner bag of FIG. 4. The liner bag 50 shown in FIG. 11 is mainly different from the liner bag shown in FIG. 4 in that, an secondary weld line 504 is formed between two adjacent primary weld lines 502 and 503, and a secondary weld line 505 is also formed between two adjacent primary weld lines 501 and 502. The secondary weld lines 504 and 505 are both connected to the primary weld line and are inclined downward. The secondary weld lines 504 and 505 intersect with each other to form a corner, a discharge port 506 is located at the bottom of the corner. Here, the minimum distance L between the discharge port 506 and the secondary weld line is also as small as possible. Preferably, $0 \leq L \leq 20$ cm; or $0 \leq L \leq 0.1*D$, where D is the minimum of lengths and widths of the front and rear panels. More preferably, $0 \leq L \leq 10$ cm, or $0 \leq L \leq 0.05*D$. Most preferably, $0 \leq L \leq 5$ cm, or $0 \leq L \leq 0.025*D$. The rest are the same and will not be described in detail here.

It would be appreciated that the primary purpose of the secondary weld lines are to form a flow guiding structure to facilitate the discharge of liquids. The arrangement of the secondary weld lines can be variously modified, for example, only one secondary weld line can be provided, for example, only one of the secondary weld lines 504 and 505 is provided. Alternatively, more secondary weld lines can be provided. The secondary weld lines do not have to intersect each other.

Figure 12:
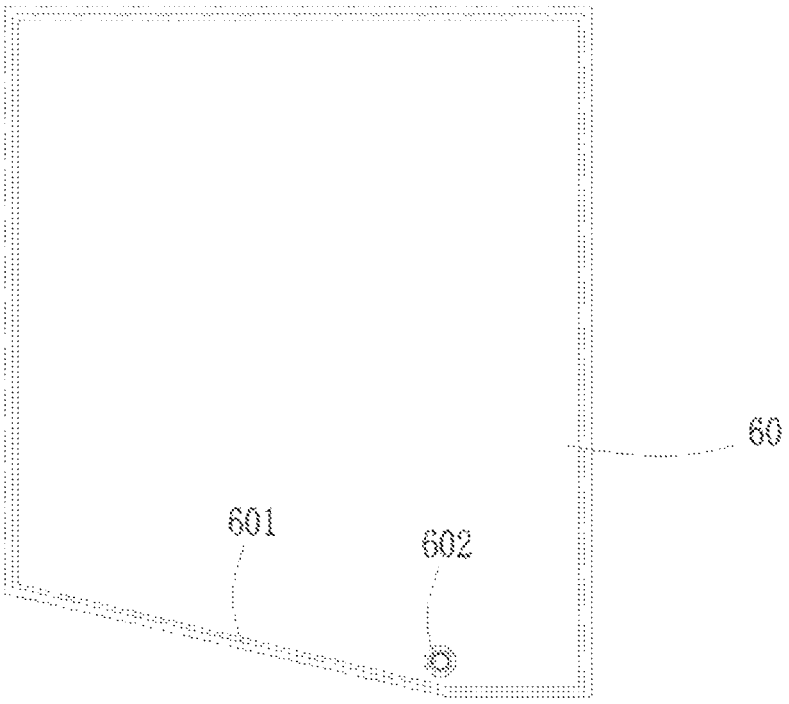
FIG. 12 is a view showing the structure of a fourth variant of the liner bag of FIG. 4.

FIG. 12 is a view showing the structure of a fourth variant of the liner bag of FIG. 4. The liner bag 60 shown in FIG. 12 is mainly different from the liner bag shown in FIG. 4 in that, the liner bag of FIG. 4 is formed by welding two rectangular sheets along the periphery thereof, and the liner bag of FIG. 12 is formed by welding two rectangular sheets with one corner 601 cut off along the periphery thereof. Here, the position relationship between the discharge port 602 and the weld line is the same as that of the liner bag of FIG. 4, and will not be described in detail herein. After the completion of the welding, the cut off corner can form a flow guiding structure, which is favorable for the discharge of liquids. The rest are the same and will not be described in detail here.

Figure 13:
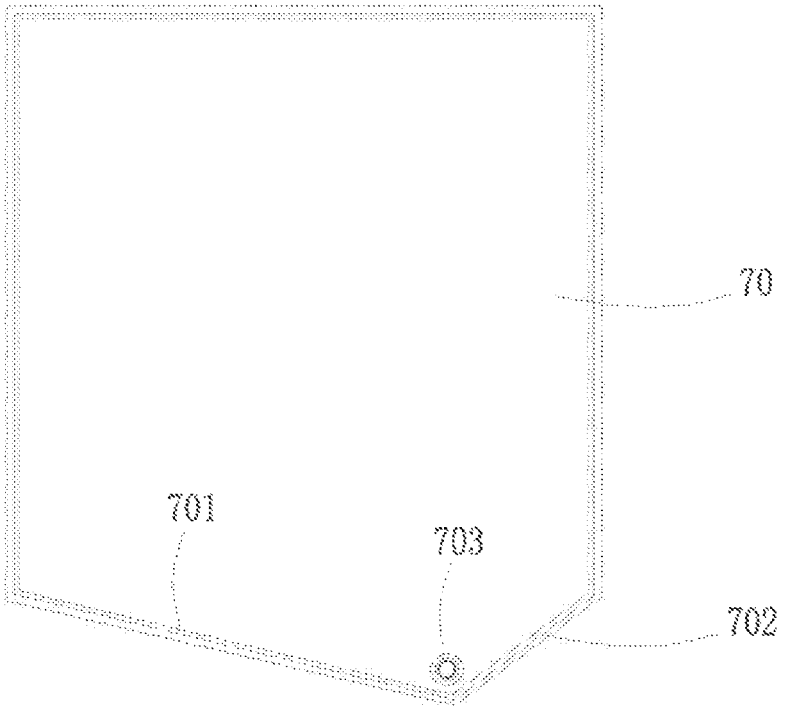
FIG. 13 is a view showing the structure of a fifth variant of the liner bag of FIG. 4.

FIG. 13 is a view showing the structure of a fifth variant of the liner bag of FIG. 4. The liner bag 70 shown in FIG. 13 is mainly different from the liner bag shown in FIG. 4 in that, the liner bag of FIG. 4 is formed by welding two rectangular sheets along the periphery thereof, and the liner bag of FIG. 13 is formed by welding two rectangular sheets with two corners 701 and 702 cut off along the periphery thereof. The cut lines of the two cut off corners intersect with each other. Here, the position relationship between the discharge port 703 and the weld line is the same as that of the liner bag of FIG. 4, and will not be described in detail herein. After the welding of two cut off corners are completed, a flow guiding structure can be formed to facilitate the discharge of liquids. The rest are the same and will not be described in detail here.

Figure 14:
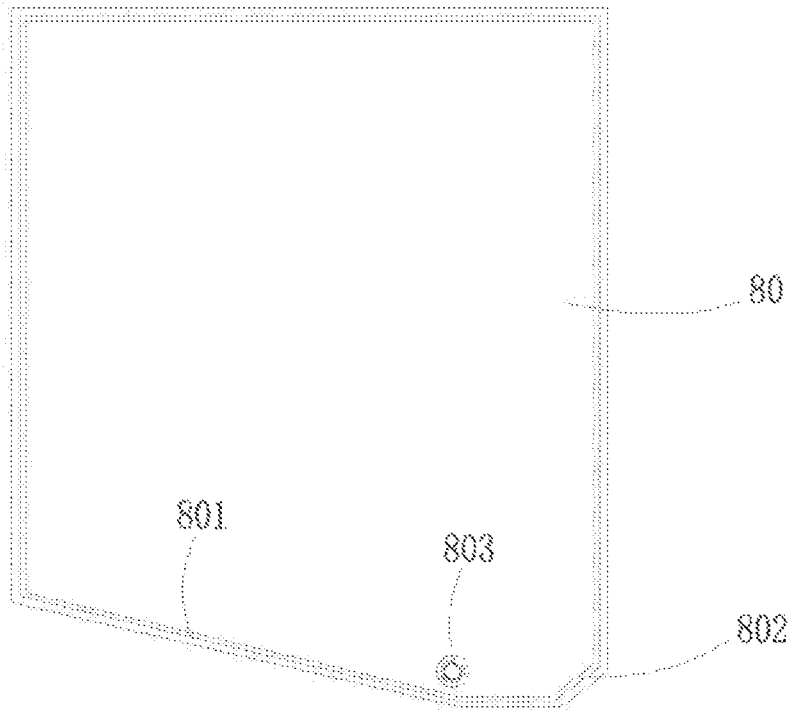
FIG. 14 is a view showing the structure of a sixth variant of the liner bag of FIG. 4.

FIG. 14 is a view showing the structure of a sixth variant of the liner bag of FIG. 4. The liner bag 80 shown in FIG. 14 is mainly different from the liner bag shown in FIG. 4 in that, the liner bag of FIG. 4 is formed by welding two rectangular sheets along the periphery thereof, and the liner bag of FIG. 14 is formed by welding two rectangular sheets with two corners 801 and 802 cut off along the periphery thereof. The cut lines of the two cut off corners don't intersect with each other (although their extension lines intersect with each other). Here, the position relationship between the discharge port 803 and the weld line is the same as that of the liner bag of FIG. 4, and will not be described in detail herein. After the welding of two cut off corners are completed, a flow guiding structure can be formed to facilitate the discharge of liquids. The rest are the same and will not be described in detail here.

Figure 15:
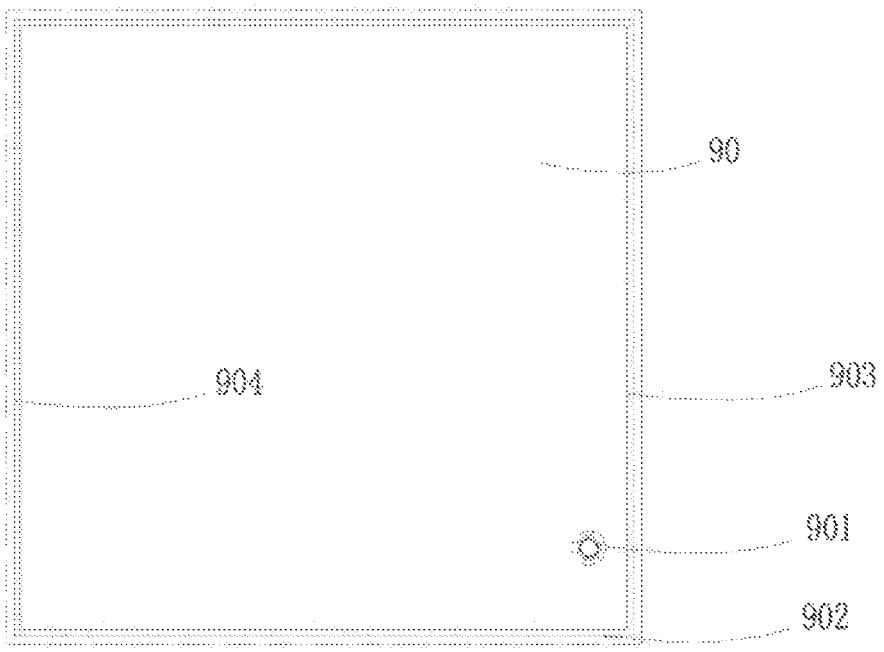
FIG. 15 is a view showing the structure of still another variant of the liner bag of FIG. 4.
Figure 16:
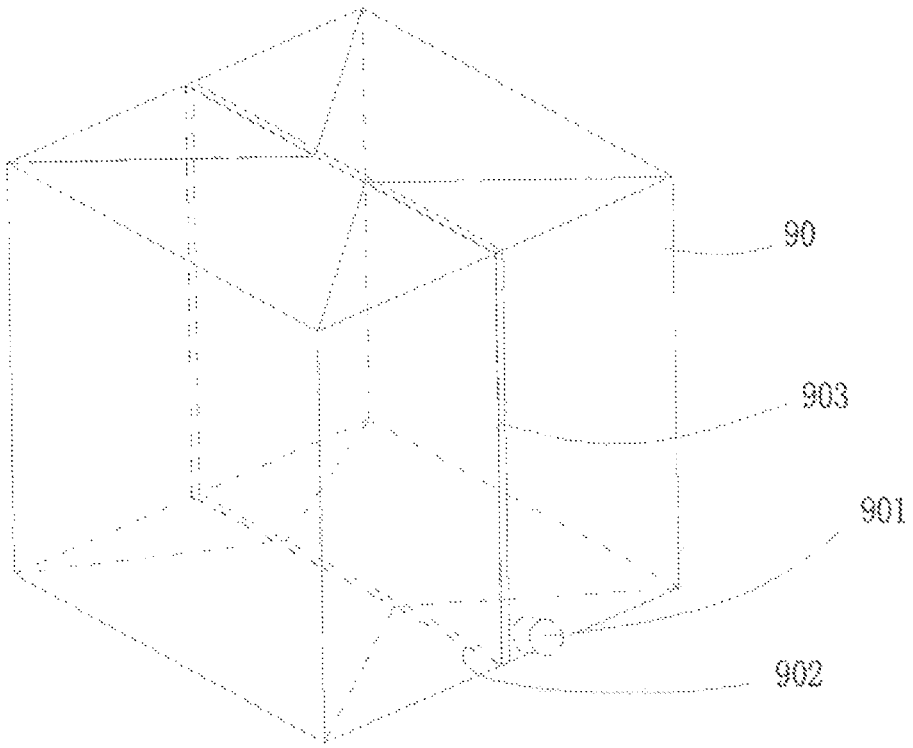
FIG. 16 is a view showing a state after the filling of the liner bag of FIG. 15 is completed.

It would be appreciated that in each of the above embodiments, the filling port may be separately provided, or the discharge port may be also used as the filling port. In the case of providing a filling port, the filling port is usually located at the top of the liner bag after the liner bag is filled with liquids. In each of the above embodiments, the discharge port is usually adjacent to a weld line on the base when the liner bag is filled with liquids. However, the discharge port may also be disposed adjacent to the weld line perpendicular to the base when the liner bag is filled with liquids and close to the base. For example, as shown in FIGS. 15 and 16, the discharge port 901 on the liner bag 90 is disposed adjacent to a weld line 903, wherein a weld line 902 is placed on the base when the liner bag is filled with liquids, and the weld line 903 is substantially perpendicular to the base. It would be appreciated that the discharge port 901 can also be disposed adjacent to a weld line 904.

The liner bag of the invention has simple welding structure, less residual amount after discharging, good manufacturing process, simple operation and cost saving, and is especially suitable for the containing and transport of viscous liquids.

Preferable embodiments of the invention have been described in detail as above. It should be understood that, after reading the above teaching of the invention, various changes or modifications of the invention can be made by those skilled in the art. All of the equivalents fall in the protection scope defined by the attached claims.

The invention claimed is:

1. A liner bag comprising:

a liner bag body, which is formed by hermetically welding a front panel and a rear panel along the periphery thereof, primary weld lines are formed along the entire periphery of the front panel and the rear panel of the liner bag body before the liner bag is filled; and a discharge port, wherein the discharge port is hermetically connected to the liner bag body, wherein the liner bag has a volume of more than 250 liters, the liner bag being used with an intermediate bulk container and a minimum distance between an edge of the discharge port and the closest primary weld line of the liner bag body is L, wherein $0 \leq L \leq 20$ cm or $0 \leq L \leq 0.1*D$, wherein D is the minimum of lengths and widths of the front and rear panels, and the liner bag is arranged in such a manner that after the liner bag is filled, a vertical plane formed by all of the primary weld lines is perpendicular to a bottom surface of the liner, and the liner bag is also arranged in such a manner that after the liner bag is filled, the liner bag body is bilaterally symmetrical about the primary weld lines that form the plane.

2. The liner bag according to claim 1, wherein the front panel and the rear panel are rectangular flexible sheets.

3. The liner bag according to claim 2, wherein the front panel and the rear panel are both formed by cutting off at least one corner of one of the rectangular flexible sheets.

4. The liner bag according to claim 2, wherein the front panel and the rear panel are both formed by cutting off two adjacent corners of one of the rectangular flexible sheets, and the two cut lines formed by cutting off the two corners intersect with each other.

5. The liner bag according to claim 1, wherein a secondary weld line is also formed between at least two primary weld lines, and is connected to the two primary weld lines.

6. The liner bag according to claim 1, wherein at least one side of the liner bag body includes at least two sections of primary weld lines which are connected to each other at an angle.

7. The liner bag according to claim 6, wherein the discharge port is located at a bottom of a corner formed by the intersection of the two sections of primary weld lines which are connected to each other at an angle.

8. The liner bag according to claim 1, wherein a size of the front panel and a size of the rear panel are defined by an area enclosed by all of the primary weld lines.

9. The liner bag according to claim 1, wherein a size of the front panel is the same as a size of the rear panel.

10. The liner bag according to claim 1, wherein a distance S between the discharge port and a closest corner of the liner bag body is greater than 20 cm.

11. A liquid transport system comprising an intermediate bulk container and a liner bag, wherein the intermediate bulk container comprises a base and a side wall mounted to the base, the base is provided with a valve port, the liner bag comprises a liner bag body and a discharge port, and the liner bag has a volume of more than 250 liters, wherein:

the liner bag body is formed by hermetically welding a front panel and a rear panel along the periphery thereof, primary weld lines are formed along the entire periphery of the front panel and the rear panel of the liner bag body before the liner bag is filled, the discharge port is hermetically connected to the liner bag body, and a minimum distance between an edge of the discharge port and the closest primary weld line of the liner bag body is L, wherein $0 \leq L \leq 20$ cm, or $0 \leq L \leq 0.1*D$, where D is the minimum of lengths and widths of the front and rear panels;

the liner bag is disposed in the intermediate bulk container and the discharge port of the liner bag is installed in the valve port; and the liner bag is arranged in such a manner that after the liner bag is filled, a vertical plane formed by all of the primary weld lines is perpendicular to the base, and the liner bag is also arranged in such a manner that after the liner bag is filled, the liner bag body is bilaterally symmetrical about the primary weld lines that form the plane.

12. The liquid transport system according to claim 11, wherein the front panel and the rear panel are both formed by cutting off at least one corner of a rectangular sheet; or the front panel and the rear panel are both formed by cutting off two adjacent corners of a rectangular sheet, and the two cut lines formed by cutting off the two corners intersect with each other.

13. A method for using a liner bag, comprising:

providing a liner bag comprising a liner bag body, which is formed by hermetically welding a front panel and a rear panel along the periphery thereof, and primary weld lines are formed along the entire periphery of the front panel and the rear panel of the liner bag body before the liner bag is filled, wherein the liner bag has a volume of more than 250 liters; and a discharge port, which is hermetically connected to the liner bag body, and the minimum distance between an edge of the discharge port and the closest primary weld line of the liner bag body is L, wherein $0 \leq L \leq 20$ cm, or $0 \leq L \leq 0.1*D$, where D is the minimum of lengths and widths of the front and rear panels;

placing the liner bag in an intermediate bulk container, wherein the intermediate bulk container comprises a base and a side wall mounted to the base, the base is provided with a valve port where the discharge port of the liner bag is installed; and arranging the liner bag in such a manner that after the liner bag is filled, a vertical plane formed by all of the primary weld lines is perpendicular to the base, and the liner bag is also arranged in such a manner that after the liner bag is filled, the liner bag body is bilaterally symmetrical about the primary weld lines that form the plane.

14. The method of using a liner bag according to claim 13, wherein the front panel and the rear panel are both formed by cutting off at least one corner of a rectangular sheet; or the front panel and the rear panel are both formed by cutting off two adjacent corners of a rectangular sheet, and the two cut lines formed by cutting off the two corners intersect with each other.

* * * * *